US006510295B2

(12) United States Patent
Noguchi et al.

(10) Patent No.: US 6,510,295 B2
(45) Date of Patent: Jan. 21, 2003

(54) IMAGE FORMING APPARATUS

(75) Inventors: Hidetoshi Noguchi, Aichi-Ken (JP); Yasunori Nakayama, Gamagoori (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/874,288

(22) Filed: Jun. 6, 2001

(65) Prior Publication Data

US 2001/0051056 A1 Dec. 13, 2001

(30) Foreign Application Priority Data

Jun. 13, 2000 (JP) ..... 2000-176850

(51) Int. Cl.[7] ..... G03G 15/16
(52) U.S. Cl. ..... 399/66
(58) Field of Search ..... 399/66

(56) References Cited

U.S. PATENT DOCUMENTS

| | | | |
|---|---|---|---|
| 5,684,685 A | 11/1997 | Komatsu et al. | |
| 6,021,287 A | 2/2000 | Tanaka | |
| 6,026,257 A | 2/2000 | Takami et al. | |

FOREIGN PATENT DOCUMENTS

| | | | |
|---|---|---|---|
| JP | 07-028294 | | 1/1995 |
| JP | 8-220902 | * | 8/1996 |
| JP | 11-288180 | * | 10/1999 |
| JP | 2000-162888 | * | 6/2000 |

* cited by examiner

*Primary Examiner*—Quana M. Grainger
(74) *Attorney, Agent, or Firm*—Morrison & Foerster LLP

(57) ABSTRACT

Four image forming units corresponding to yellow, magenta, cyan and black color toners are disposed in row along a rotatable intermediate transfer belt. Primary transfer rollers for primarily transferring images formed by respective image forming units to the intermediate transfer belt and a secondary transfer roller for secondarily transferring the images on the intermediate transfer belt to a paper sheet are also disposed. During the warm-up time, simultaneous controls for determining transfer voltages to be applied to those primary transfer rollers for yellow and cyan and the secondary transfer roller are performed first. Thereafter, simultaneous controls for determining transfer voltages to be applied to those primary transfer rollers for magenta and black are performed. The controls performed in such a manner make it possible to complete the determination of the primary transfer voltages in a shorter time, thereby shortening the warm-up time.

11 Claims, 3 Drawing Sheets

IMAGE FORMING APPARATUS

This application claims priority to Japanese Patent Application No. 2000-176850 filed Jun. 13, 2000, the entire content of which is hereby incorporated by reference.

BACKGROUND OF THE INVENTION

1. Field of the Invention

The present invention relates to so-called tandem-type color image forming apparatus.

2. Description of the Related Art

Color image forming apparatus of the so-called tandem type are known from, for example, Japanese Patent Laid-Open Gazette No. HEI 7-28294, in which a plurality of image forming units containing respective color toners are disposed along a transfer-receiving medium.

In image forming apparatus of this type, images each colored different than another formed by respective image forming units are primarily transferred to an intermediate transfer belt as superimposed one upon another by means of a transfer member such as a transfer roller and the images thus superimposed are then secondarily transferred as a single image to a paper sheet from the intermediate transfer belt by means of a transfer member. Alternatively, the images formed by respective image forming units are transferred to a paper sheet being fed by a feeding transfer belt by means of a transfer member. The image on the paper sheet is fused there to by heating during the passage through a fusion unit and then ejected to an ejected paper receiving tray.

In such a prior art tandem-type image forming apparatus, control over the transfer power, specifically, control over the transfer current or the transfer voltage, for example, Active Transfer Voltage Control (ATVC) is performed to maintain the transfer performance constant notwithstanding any change in environmental conditions or the like. The ATVC is such that a voltage to be applied to a transfer member when any image is not formed is controlled so that a current flowing through the transfer member assumes a predetermined constant value and a transfer voltage to be applied to the transfer member when an image is formed is determined based on the voltage applied when any image is not formed. This transfer voltage is controlled to be constant during the image forming operation. The ATVC ensures constant transfer performance thereby to allow stabilized images to be formed.

In such a prior art tandem-type color image forming apparatus, however, the control for determining a transfer current for a primary transfer roller is performed separately from that for a secondary transfer roller and, hence, it takes a long time to complete the controls for determining all the necessary transfer currents. Particularly where the control for determining a transfer current is performed during a warm-up time after the power supply of the image forming apparatus has been turned on, a longer warm-up time must be secured.

SUMMARY OF THE INVENTION

A chief object of the present invention is to provide a tandem-type image forming apparatus which requires a shorter period of time for completing controls for determining transfer powers.

Another object of the present invention is to provide a tandem-type image forming apparatus which is capable of ensuring constant transfer performance thereby to form stabilized images.

These and other objects can be attained by an image forming apparatus comprising: rotatable transfer-receiving medium; a plurality of image forming devices disposed in row along the transfer-receiving medium for forming respective images each colored different than another; transfer members each disposed at a location opposite to each of the image forming devices across the transfer-receiving medium and applied with respective transfer powers for causing the images formed by respective image forming devices to transfer to the transfer-receiving medium; and a controller configured to simultaneously perform controls for determining the transfer powers to be applied to those transfer members which are not located adjacent to each other while performing controls for determining the transfer powers to be applied to those transfer members which are located adjacent to each other at separate times.

Particularly where an image forming apparatus is of the type wherein images primarily transferred to the transfer-receiving medium are secondarily transferred to a paper sheet, the aforementioned objects can be attained by an image forming apparatus comprising: rotatable transfer-receiving medium; a plurality of image forming devices disposed in row along the transfer-receiving medium for forming respective images each colored different than another; primary transfer members each disposed at a location opposite to each of the image forming devices across the transfer-receiving medium and applied with primary transfer powers for causing the images formed by respective image forming devices to primarily transfer to the transfer-receiving medium; a secondary transfer member disposed in contact with the transfer-receiving medium and applied with a secondary transfer power for causing the images primarily transferred to the transfer-receiving medium to secondarily transfer to a paper sheet passing through the contact portion thereof; and a controller configured to simultaneously perform controls for determining the transfer powers to be applied to those transfer members which are not located adjacent to each other while performing controls for determining the transfer powers to be applied to those transfer members which are located adjacent to each other at separate times.

Such image forming apparatus are adapted to simultaneously perform controls for determining the transfer powers to be applied to those transfer members which are not located adjacent to each other and hence are capable of completing the determination of the transfer powers in a shorter time than the case where controls for sequentially determining the transfer powers for every transfer member are performed. Accordingly, when such controls are performed during the warm-up time after the power has been turned on, the time required for warm-up can be shortened. Further, the image forming apparatus are adapted to perform controls for determining the transfer powers to be applied to those transfer members which are located adjacent to each other at separate times and hence are capable of determining the transfer powers with higher precision.

The image forming apparatus described above may be configured such that the controls for simultaneously determining the primary transfer powers to be applied to first and third ones of the transfer members as counted from the upstream side in a moving direction of the transfer-receiving medium are performed separately from the controls for simultaneously determining the primary transfer powers to second and fourth ones of the transfer members as counted from the upstream side in the moving direction of the transfer-receiving medium.

Also, it is possible that the control for determining the secondary transfer power is performed simultaneously with the controls for determining the primary transfer powers to be applied to the primary transfer members.

Such an arrangement may be employed that the primary transfer members and the secondary transfer members may be identically-shaped members constructed of a same material and the secondary transfer power is determined based on the primary transfer powers having been determined.

Preferably, an automatic density control and a registration correction are performed after the primary transfer powers and the second transfer power have been determined.

The transfer-receiving medium may be an intermediate transfer belt, a transfer conveyor belt, or a like member.

The aforementioned objects of the present invention can also be attained by an image forming apparatus comprising: rotatable transfer-receiving medium; a plurality of image forming devices disposed in row along the transfer-receiving medium for forming respective images each colored different than another; primary transfer members each disposed at a location opposite to each of the image forming devices across the transfer-receiving medium and applied with respective primary transfer powers for causing the images formed by respective image forming devices to primarily transfer to the transfer-receiving medium; a secondary transfer member disposed in contact with the transfer-receiving medium and applied with a secondary transfer power for causing the images primarily transferred to the transfer-receiving medium to secondarily transfer to a paper sheet passing through the contact portion thereof; and a controller configured to first perform a control for determining the secondary transfer power and then perform controls for determining the primary transfer powers based on the secondary transfer power having been determined.

The invention itself, together with further objects and attendant advantages, will best be understood by reference to the following detailed description taken in conjunction with the accompanying drawings.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
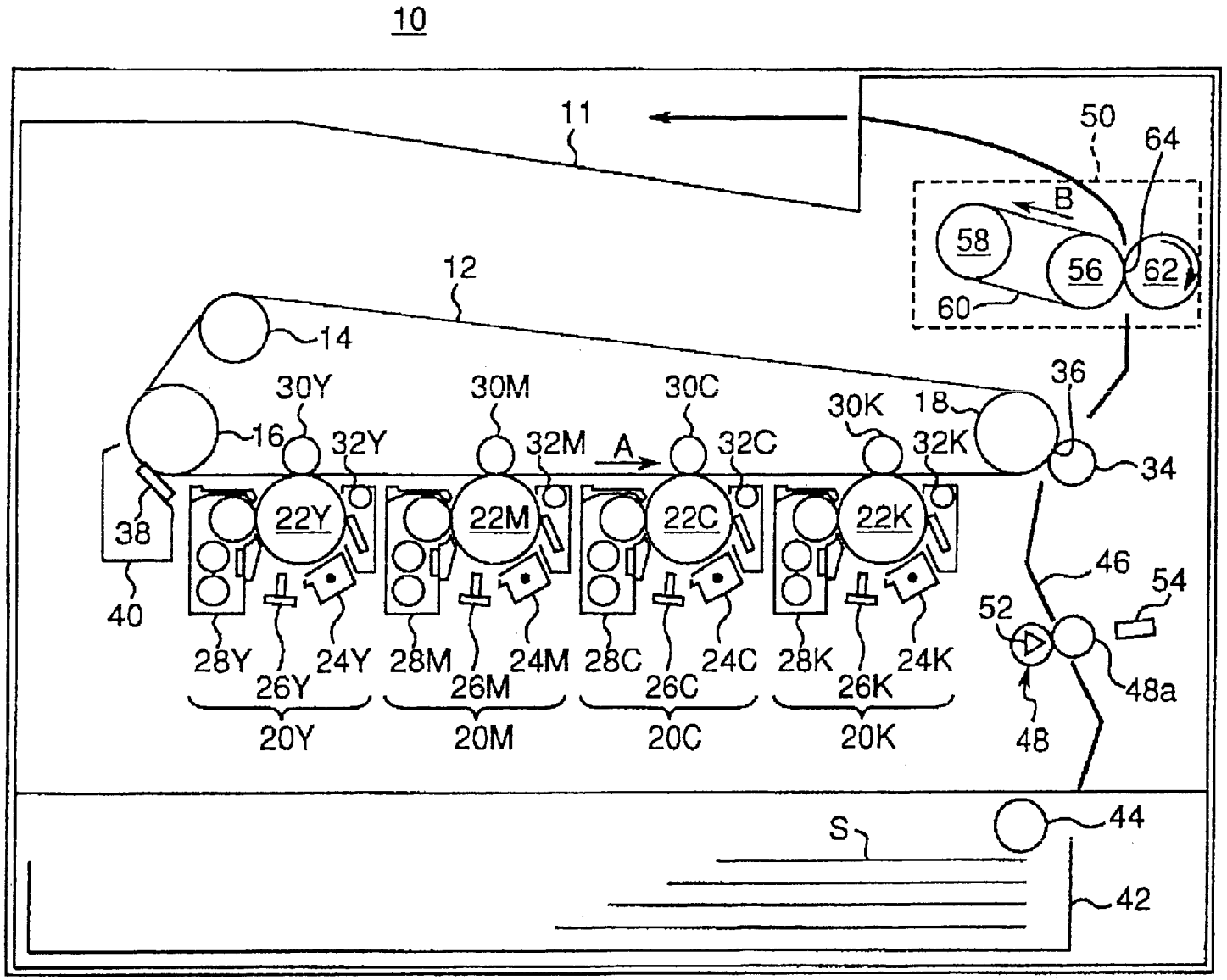
FIG. 1 is a view illustrating the overall construction of a printer.

The present invention will now be described in detail by way of embodiments thereof shown in the attached drawings. FIG. 1 illustrates the overall construction of a tandem-type digital color printer (hereinafter referred to as "printer" simply) 10 as one embodiment of the present invention.

The printer 10 includes an intermediate transfer belt 12 in a substantially central section within the inside thereof. The intermediate transfer belt 12 made of a semiconductive material is supported by the outer peripheries of three rollers 14, 16 and 18 for rotation in the direction indicated by arrow A.

Under and along the horizontally extending lower portion of the intermediate belt 12 are disposed a row of four image forming units 20Y, 20M, 20C and 20K corresponding to different color toners that will develop yellow (Y), magenta (M), cyan (C), and black (K), respectively.

The image forming units 20Y, 20M, 20C and 20K have photosensitive drums 22Y, 22M, 22C and 22K, respectively. Around respective photosensitive drums 22Y, 22M, 22C and 22K are disposed sequentially in the direction of their rotation chargers 24Y, 24M, 24C and 24K adapted to cause the surfaces of the photosensitive drums 22Y, 22M, 22C and 22K to be electrostatically charged uniformly, print heads 26Y, 26M, 26C and 26K each configured to form an electrostatic latent image on each photosensitive drum by exposing the photosensitive drum surface to light according to data of each color image, developers 28Y, 28M, 28C and 28K each configured to develop the electrostatic latent image formed on each photosensitive drum surface with a corresponding color toner to form a toner image, primary transfer rollers 30Y, 30M, 30C and 30K disposed at locations opposite to the corresponding photosensitive drums 22Y, 22M, 22C and 22K across the intermediate transfer belt 12 so as to be in contact with the internal side of the intermediate transfer belt 12 for primarily transferring the toner image formed on each photosensitive drum surface onto the intermediate transfer belt 12, and cleaners 32Y, 32M, 32C and 32K each configured to collect residual toner left on each photosensitive drum surface finished with the primary transfer to achieve cleaning of the photosensitive drum surface. The print heads 26Y, 26M, 26C and 26K each comprise a multiplicity of LEDs arranged in the primary scanning direction which is parallel with the axis of each photosensitive drum.

A secondary transfer roller 34 is in pressure contact with the external side of the intermediate transfer belt 12 at a location where the intermediate transfer belt 12 is supported by the roller 18. The contact portion between the secondary transfer roller 34 and the intermediate transfer belt 12 serves as a transfer region 36. The secondary transfer roller 34 is retractable into a position where it fails to contact the intermediate transfer belt 12.

Figure 2:
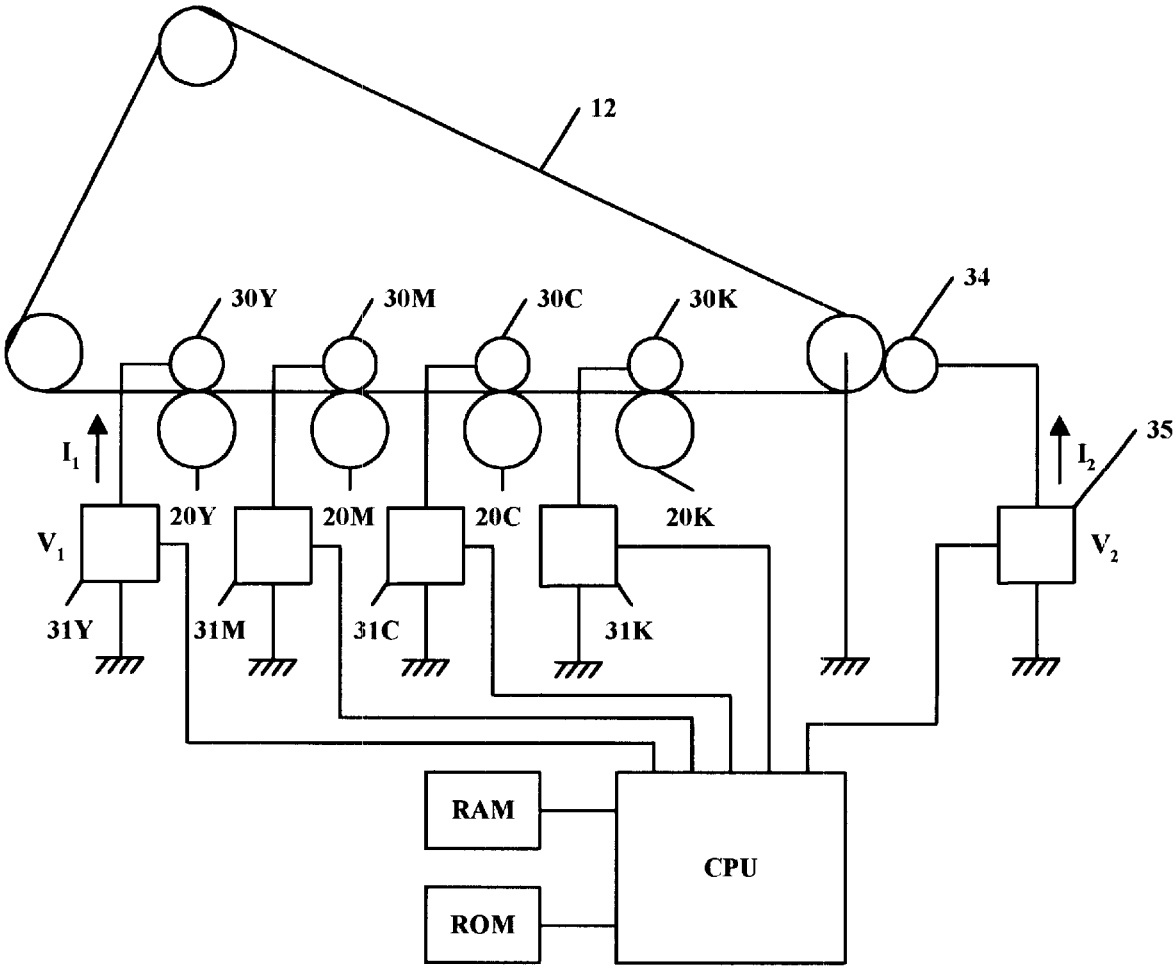
FIG. 2 is a block diagram showing a control circuit.

As shown in FIG. 2, the primary transfer roller 30Y is applied with a primary transfer voltage $V_1$ of positive polarity by a power supply 31. Similarly, other primary transfer rollers 30M, 30C and 30K are applied with respective primary transfer voltages of positive polarity. The application of the primary transfer voltages causes the color toner images formed on respective photosensitive drums 22Y, 22M, 22C and 22K of the image forming units 20Y, 20M, 20C and 20K to be electrostatically attracted, thereby achieving the primary transfer onto the intermediate transfer belt 12.

The secondary transfer roller 34 is applied with a secondary transfer voltage $V_2$ of positive polarity by a power supply 35, and the roller 18 supporting the intermediate transfer belt 12 is grounded. The application of the secondary transfer voltage $V_2$ causes the toner image on the intermediate transfer belt 12 to be electrostatically attracted by a paper sheet fed to the transfer region 36 as will be described later, thereby achieving the secondary transfer. The outputs of respective power supplies 31Y, 31M, 31C and 31K are controlled by a CPU. The CPU executes programs stored in a ROM by utilizing a RAM.

Referring again to FIG. 1, a cleaner 38 is disposed in pressure contact with the intermediate transfer belt 12 at a location where the intermediate transfer belt 12 is supported by the roller 16. The cleaner 38 serves to scrape off and collect residual toner left on the intermediate transfer belt 12 finished with the secondary transfer into a waste toner box 40. Like the secondary transfer roller 34, the cleaner 38 is also retractable into a position where it fails to contact the intermediate transfer belt 12.

A paper-feeding cassette 42 is removably fitted in a lower portion of the printer 10. The paper-feeding cassette 42 contains a stack of paper sheets S to be delivered to a feeding path 46 one by one from the uppermost one.

The feeding path 46 extends from the paper-feeding cassette 42 to an ejected paper receiving tray 11 through the nipping portion of a timing roller pair 48, the secondary transfer region 36 and a fusion unit 50. The timing roller pair 48 acts to feed paper sheet S fed from the paper-feeding cassette 42 to the transfer region 36 synchronously with an image on the intermediate transfer belt 12.

A timing sensor 52 is disposed adjacent the timing roller pair 48. The timing sensor 52 detects the occurrence of paper sheet S nipped at its leading edge by the timing roller pair 48. When the timing sensor 52 detects the leading edge of paper sheet S, the timing roller pair 48 temporarily stops its rotation and then feeds the paper sheet S to the transfer region 36 synchronously with the toner image on the intermediate transfer belt 12.

A paper thickness sensor 54 is disposed facing one roller 48′aof the timing roller pair 48. The paper thickness sensor 54 measures the amount of a shift of the roller 48*a* caused when the leading edge of paper sheet S is nipped by the timing roller pair 48, thereby judging the paper sheet nipped to be an ordinary paper sheet, a cardboard sheet having a relatively large thickness, or an OHP sheet.

The fusion unit 50 includes a fusing belt 60 supported by a pair of rollers 56 and 58 for rotation in the direction indicated by arrow B, and a fusing roller 62 driven for rotation in the direction indicated by a relevant arrow by the roller 56 in pressure contact therewith through the fusing belt 60. The nipping portion between the fusing belt 60 and the fusing roller 62 through which a paper sheet bearing the toner image secondarily transferred thereto passes, defines a fusing region 64. The fusing belt 60 is heated by a heater.

The printer 10 thus constructed operates as follows.

When image signals are input to an image signal processing section of the printer 10 from an external apparatus (for example, a personal computer), the image signal processing section creates digital image signals which are color-converted into yellow, magenta, cyan and black from the image signals received, and transmits the digital image signals to an LED driving circuit associated with the print heads. The driving circuit causes the print heads 26Y, 26M, 26C and 26K of respective image forming units 20Y, 20M, 20C and 20K to emit light for exposure based on the digital image signals input thereto. The exposure is performed in the sequence of print heads 26Y, 26M, 26C and 26K with a certain time lag between one head and the succeeding one. Thus, electrostatic latent images for respective colors are formed on the surfaces of the photosensitive drums 22Y, 22M, 22C and 22K.

The electrostatic latent images formed on respective photosensitive drums 22Y, 22M, 22C and 22K are then developed into corresponding toner images in respective colors by the developers 28Y, 28M, 28C and 28K. The color toner images are primarily transferred to the intermediate transfer belt 12 moving in the direction indicated by arrow A so as to be superimposed one upon another sequentially by the actions of the primary transfer rollers 30Y, 30M, 30C and 30K applied with respective primary transfer voltages of positive polarity.

The superimposed toner images thus formed on the intermediate transfer belt 12 reaches the transfer region 36 as the intermediate transfer belt 12 moves. In the transfer region, the secondary transfer roller 34, which is applied with a secondary transfer voltage of the same polarity as the primary transfer voltages, causes the superimposed toner images to be secondarily transferred collectively to a paper sheet S fed from the paper-feeding cassette 42 to the feeding path 46 and then passing through the transfer region 36 by the timing roller pair 48. Residual toner left on the intermediate transfer belt 12 after the secondary transfer has been completed is collected by the cleaner 38.

The paper sheet S bearing the toner image secondarily transferred thereto is fed to the fusion unit 50 through the feeding path 46, and when the sheet S passes through the fusing region 64 of the fusion unit 50, the toner image are fused to the sheet S by heating. Finally, the paper sheet S is ejected into the ejected paper receiving tray 11.

Unlike the operation of forming a color image thus performed, the operation of forming a monochrome image is performed as follows. Only the image forming unit 20K operates based on monochrome image data received to form a black toner image on the intermediate transfer belt 12. Thereafter, in the same manner as in the formation of a color image, the black toner image is secondarily transferred to a paper sheet Sin the transfer region 36 and then fused to the paper sheet S by heating in the fusion unit 50, followed by ejection into the ejected paper receiving tray 11.

Meanwhile, the prior art image forming apparatus has primary transfer roller and secondary transfer roller that are disposed in contact with the internal side of an intermediate transfer belt and are applied with respective primary transfer voltage and secondary transfer voltage which are different in polarity. In such an arrangement, if the intermediate transfer belt is made of a conductive or semiconductive material and the primary and secondary transfer rollers are located relatively close to each other, a large current flows through the intermediate transfer belt between the primary and the secondary transfer rollers. Such a large current may break the texture of the intermediate transfer belt, hence damage the belt, resulting in the intermediate transfer belt having a problematically shorter life. If the primary and the secondary transfer rollers are spaced a larger distance from each other, a smaller current flows through the intermediate transfer belt between the two. Such an arrangement, however, inevitably upsizes the apparatus as a whole and hence cannot be employed in view of the downsizing trend, though any significant damage to the belt is unlikely. In order to prevent toner from adhering to the transfer rollers and the intermediate transfer belt, the powers for use in respective primary transfer and secondary transfer are off except during the formation of an image. In this case, if the distance between the primary and the secondary transfer rollers is not sufficient, a current flowing into each transfer roller steeply changes, resulting in an unstable transfer power output.

In the printer 10 according to the subject embodiment of the invention, in contrast, the primary and the secondary transfer voltages are of the same polarity in the image forming operation and, hence, no current flows through the intermediate transfer belt 12 between the primary transfer roller 30K and the secondary transfer roller 34, or even if a current flows therethrough, such a current is far smaller than that flows in the case where the two transfer voltages are different in polarity. Accordingly, damage to the intermediate transfer belt 12 and the shorter life problem of the belt 12 can be prevented. Further, such an arrangement allows the printer 10 to be downsized because any inconvenience will not occur if the primary and the secondary transfer rollers are located closer to each other.

It should be noted that though the primary and the secondary transfer voltages are of positive polarity on the assumption that the toners used are negatively chargeable in the subject embodiment, the primary and the secondary transfer voltages may be of negative polarity if the toners used are positively chargeable. Since the secondary transfer roller 34 is in contact with the external side of the intermediate transfer belt 12, it is possible that residual toner on the intermediate transfer belt 12 adheres to the outer periphery of the secondary transfer roller 34. In such a case, the secondary transfer roller 34 maybe cleaned in such a manner that the secondary transfer voltage is switched to a voltage of the same polarity as the toners (namely, negative polarity) to generate an electrostatic repulsive force thereby repulsing the adhering toner to the intermediate transfer belt 12.

Figure 3:
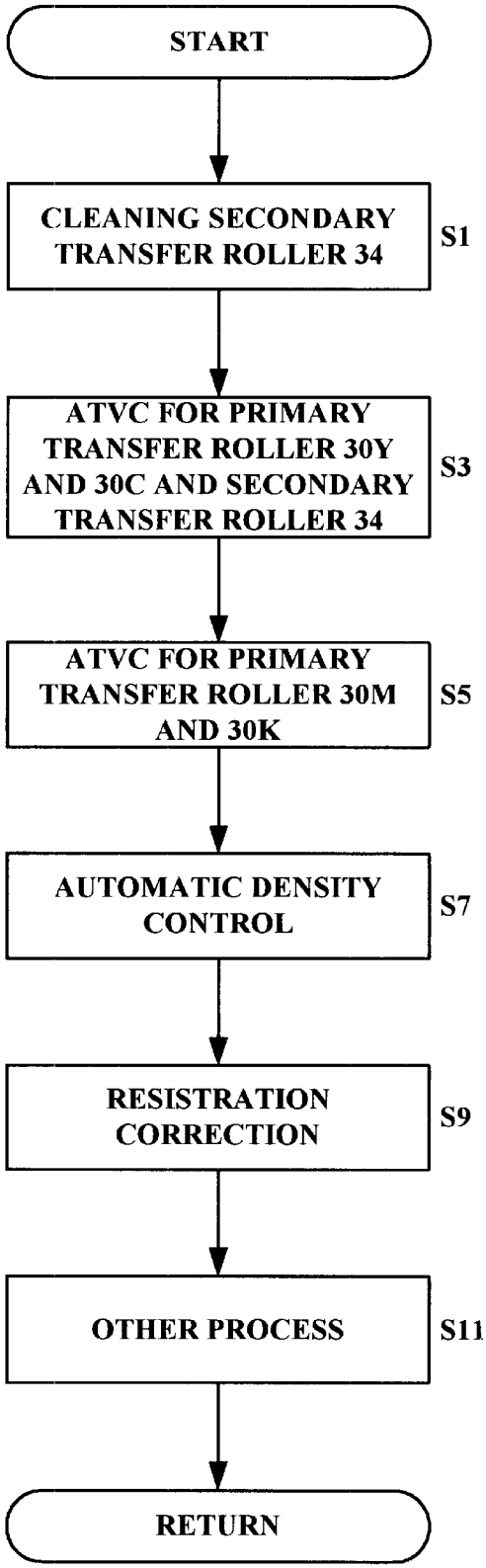
FIG. 3 is a flowchart of a control exerted by a CPU.

Described below with reference to FIG. 3 is a control performed during the warm-up time after the printer 10 of the subject embodiment has been powered on.

FIG. 3 illustrates the control according to a program executed by the CPU.

First, when the power supply of the printer 10 is turned on, cleaning of the secondary transfer roller 34 is performed (step S1). Subsequently, ATVCs for determining respective transfer voltages to be applied to the primary transfer rollers 30Y and 30C that are not located adjacent to each other and the secondary transfer roller 34 are performed simultaneously (step S3). Thereafter, ATVCs for determining respective transfer voltages to be applied to the primary transfer rollers 30M and 30K are performed simultaneously (step S5).

Once the primary transfer voltages $V_1$ and the secondary transfer voltage $V_2$ have been determined, an automatic density control for adjusting the density of an image by supply of toner or the like is performed in order to ensure the image having a predetermined level of density (step S7), and registration correction is performed to register the images transferred from respective image forming units 20Y, 20M, 20C and 20K with each other (step S9)

Since ATVCs for the primary transfer rollers 30Y and 30C and the secondary transfer roller 34 are performed simultaneously and also ATVCs for the primary transfer rollers 30M and 30K are performed simultaneously, the transfer voltages can be determined in a shorter time than in the case where ATVCs for all the transfer members are performed one by one. As a result, the warm-up time can be shortened.

Further, the ATVCs for the first and third primary transfer rollers 30Y and 30C as counted from the upstream side in the moving direction (indicated by arrow A) of the intermediate transfer belt 12 and the ATVCs for the second and fourth primary transfer rollers 30M and 30K are performed at separate times. By so doing, it is possible to simultaneously perform ATVCs for those primary transfer rollers which are largely spaced from each other, whereby mutual interference between ATVCs can be minimized to ensure higher precision ATVCs.

Simultaneously with the ATVCs for the primary transfer rollers 30Y, 30C and 30K, ATVC for the secondary transfer roller 34 is performed. Accordingly, the primary transfer voltages $V_1$, and the secondary transfer voltage $V_2$ can be determined in a shorter time thereby further shortening the warm-up time. In this case, the ATVC for the primary transfer roller 30K is not performed simultaneously with the ATVC for the secondary transfer roller 34. This is to provide a larger spacing between the secondary transfer roller 34 and the primary transfer roller for which ATVCs are performed simultaneously, there by minimizing mutual interference between the ATVCs to ensure higher precision ATVCs.

When the automatic density control and the registration correction are performed after the necessary ATVCs have been completed, the automatic density control and the registration correction can be achieved using a stabilized reference toner image that has been formed with proper transfer performance ensured by ATVCs. Thus, the automatic density control and the registration correction can be performed accurately.

It is possible that using primary transfer voltage $V_1$ determined by ATVC performed for at least one of the primary transfer rollers 30Y, 30M, 30C and 30K, primary transfer voltages $V_1$ to be applied to the remaining primary transfer rollers and secondary transfer voltage $V_2$ are determined with out performing any ATVC. Reversely, it is possible that using secondary transfer voltage $V_2$ first determined by ATVC performed for the secondary transfer roller 34, primary transfer voltages $V_1$ to be applied to respective primary transfer rollers 30Y, 30M, 30C and 30K are determined without performing any ATVC. In this case, the transfer voltages can be determined with higher precision if the primary transfer rollers 30Y, 30M, 30C and 30K and the secondary transfer roller 34 respectively comprise identically-shaped rollers constructed of the same material.

It should be noted that although the foregoing description is directed to the case where ATVCs are performed during the warm-up time after the power supply of the apparatus has been turned on, such ATVCs may be performed in the manner described above upon opening or closing of the cover or on a predetermined prints count basis.

Controls for determining the transfer powers may be performed by any other method than the ATVC.

Although the transfer members 30Y, 30M, 30C and 30K are each in the form of roller in the foregoing embodiment, they may be in any other form.

Further, though the present invention is embodied as a printer, the invention is applicable to any other image forming apparatus such as a copying machine, facsimile apparatus, and combined apparatus comprising a printer and a copying machine or facsimile apparatus.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

rotatable transfer-receiving medium;

a plurality of image forming devices disposed in row along the transfer-receiving medium for forming respective images each colored different than another;

primary transfer members each disposed at a location opposite to each of the image forming devices across the transfer-receiving medium and applied with primary transfer powers for causing the images formed by respective image forming devices to primarily transfer to the transfer-receiving medium;

a secondary transfer member disposed in contact with the transfer-receiving medium and applied with a secondary transfer power for causing the images primarily transferred to the transfer-receiving medium to secondarily transfer to a paper sheet passing through the contact portion thereof; and a controller configured to simultaneously perform controls for determining the transfer powers to be applied to those transfer members which are not located adjacent to each other while performing controls for determining the transfer powers to be applied to those transfer members which are located adjacent to each other at separate times.

2. An image forming apparatus according to claim 1, wherein said controller performs the controls for simultaneously determining the primary transfer powers to be applied to first and third ones of the transfer members as counted from the upstream side in a moving direction of the transfer-receiving medium separately from the controls for simultaneously determining the primary transfer powers to second and fourth ones of the transfer members as counted from the upstream side in the moving direction of the transfer-receiving medium.

3. An image forming apparatus according to claim 1, wherein said controller performs the control for determining the secondary transfer power simultaneously with the controls for determining the primary transfer powers.

4. An image forming apparatus according to claim 1, wherein the secondary transfer power is determined based on the primary transfer powers having been determined.

5. An image forming apparatus according to claim 4, wherein the primary transfer members and the secondary transfer members may be identically-shaped members constructed of a same material.

6. An image forming apparatus according to claim 1, herein an automatic density control and a registration correction are performed after the primary transfer powers and the second transfer power have been determined.

7. An image forming apparatus according to claim 1, wherein the transfer-receiving medium includes an intermediate transfer belt.

8. An image forming apparatus comprising:

rotatable transfer-receiving medium;

a plurality of image forming devices disposed in row along the transfer-receiving medium for forming respective images each colored different than another;

primary transfer members each disposed at a location opposite to each of the image forming devices across the transfer-receiving medium and applied with respective primary transfer powers for causing the images formed by respective image forming devices to primarily transfer to the transfer-receiving medium;

a secondary transfer member disposed in contact with the transfer-receiving medium and applied with a secondary transfer power for causing the images primarily transferred to the transfer-receiving medium to secondarily transfer to a paper sheet passing through the contact portion thereof; and a controller configured to first perform a control for determining the secondary transfer power and then perform controls for determining the primary transfer powers based on the secondary transfer power having been determined.

9. An image forming apparatus according to claim 8, wherein the primary transfer members and the secondary transfer members are identically-shaped members constructed of a same material.

10. An image forming apparatus comprising:

rotatable transfer-receiving medium;

a plurality of image forming devices disposed in row along the transfer-receiving medium for forming respective images each colored different than another;

transfer members each disposed at a location opposite to each of the image forming devices across the transfer-receiving medium and applied with respective transfer powers for causing the images formed by respective image forming devices to transfer to the transfer-receiving medium; and a controller configured to simultaneously perform controls for determining the transfer powers to be applied to those transfer members which are not located adjacent to each other while performing controls for determining the transfer powers to be applied to those transfer members which are located adjacent to each other at separate times.

11. An image forming apparatus according to claim 10, wherein said controller performs the controls for simultaneously determining the primary transfer powers to be applied to first and third ones of the transfer members as counted from the upstream side in a moving direction of the transfer-receiving medium separately from the controls for simultaneously determining the primary transfer powers to second and fourth ones of the transfer members as counted from the upstream side in the moving direction of the transfer-receiving medium.

* * * * *

UNITED STATES PATENT AND TRADEMARK OFFICE

CERTIFICATE OF CORRECTION

PATENT NO. : 6,510,295 B1
DATED : January 21, 2003
INVENTOR(S) : Hidetoshi Noguchi et al.

It is certified that error appears in the above-identified patent and that said Letters Patent is hereby corrected as shown below:

Column 9,
Line 27, please change “herein” to -- wherein --.

Signed and Sealed this

Twenty-second Day of April, 2003

JAMES E. ROGAN
*Director of the United States Patent and Trademark Office*